US007429077B2

(12) United States Patent
Yul

(10) Patent No.: US 7,429,077 B2
(45) Date of Patent: Sep. 30, 2008

(54) COLLAPSIBLE FURNITURE PIECE CONFIGURABLE IN A TABLE CONFIGURATION AND A BENCH CONFIGURATION

(75) Inventor: Lee Pil Yul, Seoul (KR)

(73) Assignee: North Pole Limited, Kowloon, Hong Kong (HK)

( * ) Notice: Subject to any disclaimer, the term of this patent is extended or adjusted under 35 U.S.C. 154(b) by 0 days.

(21) Appl. No.: 11/765,106

(22) Filed: Jun. 19, 2007

(65) Prior Publication Data

US 2008/0018142 A1 Jan. 24, 2008

(30) Foreign Application Priority Data

Jun. 19, 2006 (CN) ..... 2006 2 0086018 U

(51) Int. Cl.

| | |
|---|---|
| ***A47B 85/04*** | (2006.01) |
| ***A47B 3/00*** | (2006.01) |
| ***A47B 3/14*** | (2006.01) |
| ***A47B 83/02*** | (2006.01) |
| ***A47C 13/00*** | (2006.01) |

(52) U.S. Cl. ..... 297/124; 297/118; 297/158.4; 108/11; 108/12

(58) Field of Classification Search ..... 297/158.4, 297/118, 119, 124, 125; 108/12, 11
See application file for complete search history.

(56) References Cited

U.S. PATENT DOCUMENTS

| | | | | | |
|---|---|---|---|---|---|
| 1,401,083 | A | * | 12/1921 | Jurkovich | 297/124 |
| 1,473,702 | A | * | 11/1923 | Guthridge et al. | 297/124 |
| 1,757,960 | A | * | 5/1930 | Greenstreet | 297/124 |
| 1,792,737 | A | * | 2/1931 | Greenstreet | 297/124 |
| 1,890,129 | A | * | 12/1932 | Ross | 297/121 |
| 2,481,935 | A | * | 9/1949 | Larson | 297/121 |
| 2,486,468 | A | * | 11/1949 | Freedman | 297/124 X |
| 2,506,606 | A | * | 5/1950 | McCaw | 297/124 |
| 2,506,852 | A | * | 5/1950 | Barcus | 297/121 |
| 2,509,556 | A | * | 5/1950 | Zimmerman et al. | 297/124 |
| 2,558,465 | A | * | 6/1951 | Seymour | 297/158.4 X |
| 2,561,703 | A | * | 7/1951 | Koenig | 297/124 X |
| 2,645,273 | A | * | 7/1953 | Culbertson et al. | 297/126 |
| 2,675,859 | A | * | 4/1954 | Abler | 297/124 |
| 2,745,466 | A | * | 5/1956 | Thompson | 297/124 |
| 2,758,633 | A | * | 8/1956 | Apple | 297/124 |
| 2,856,985 | A | * | 10/1958 | Lepper | 297/124 |
| 2,882,957 | A | * | 4/1959 | Anderson | 297/124 |
| 2,897,876 | A | * | 8/1959 | Austin | 297/124 X |
| 2,900,009 | A | * | 8/1959 | Haynes | 297/126 |
| 2,922,463 | A | * | 1/1960 | Johnston | 297/124 |

(Continued)

*Primary Examiner*—Rodney B. White
(74) *Attorney, Agent, or Firm*—Armstrong Teasdale LLP

(57) ABSTRACT

A collapsible, configurable furniture piece including a transverse member supporting a first panel. The transverse member defines a first end portion and an opposing second end portion. A first support member is coupled to the first end portion of the transverse member. A first brace is pivotally coupled to the first support member. The first brace at least partially supports a second panel. The first support member is pivotally movable with respect to the first brace between a first configuration, wherein the first support member extends from the first brace such that the first panel is substantially parallel with the second panel, and a second configuration, wherein the first support member is substantially coplanar with the first brace such that the first panel extends at one of a right angle and an oblique angle with respect to the second panel.

25 Claims, 13 Drawing Sheets

U.S. PATENT DOCUMENTS 2,931,425 A * 4/1960 Rasco et al. ..... 297/124
2,959,209 A * 11/1960 Lakin ..... 297/124
3,028,197 A * 4/1962 Wilson ..... 297/124
3,061,369 A * 10/1962 Haunost ..... 297/124
3,361,470 A * 1/1968 Erickson et al. ..... 297/124
3,672,719 A * 6/1972 Haukedahl ..... 297/118
4,194,784 A * 3/1980 Dostal et al. ..... 297/126
4,382,627 A * 5/1983 Dean ..... 297/124
4,606,575 A * 8/1986 Kodet ..... 297/124
4,615,559 A * 10/1986 Blondeau ..... 297/124
4,647,107 A * 3/1987 Hoover et al. ..... 297/124
4,801,175 A * 1/1989 Albanese ..... 297/124
4,913,488 A * 4/1990 Donnell, Jr. ..... 297/124
5,251,955 A 10/1993 Sarafa
5,292,172 A 3/1994 Watts et al.
5,314,231 A 5/1994 Otterbacher
5,398,990 A 3/1995 Watts et al.
5,586,803 A 12/1996 Overpeck
5,692,799 A * 12/1997 Sheets ..... 297/124
5,704,683 A 1/1998 Cooper et al.
5,921,623 A 7/1999 Nye et al.
6,189,965 B1 * 2/2001 Hecht et al. ..... 297/124
6,231,121 B1 * 5/2001 Chrisco et al. ..... 297/124
6,241,312 B1 * 6/2001 Watts et al. ..... 297/125
6,347,831 B1 2/2002 Nye et al.
6,354,611 B1 3/2002 Mihalic et al.
6,523,485 B1 2/2003 Cipolla
6,659,543 B2 * 12/2003 McCutcheon et al. ..... 297/127
6,772,699 B1 8/2004 Elliott
6,883,864 B2 4/2005 Gregory
6,905,166 B2 6/2005 Zhurong et al.
7,055,899 B2 6/2006 Zhurong et al.
7,226,125 B2 * 6/2007 Frobose et al. ..... 297/158.4
2002/0140257 A1 * 10/2002 Liu ..... 297/124

* cited by examiner

COLLAPSIBLE FURNITURE PIECE CONFIGURABLE IN A TABLE CONFIGURATION AND A BENCH CONFIGURATION

CROSS REFERENCE TO RELATED APPLICATIONS

This application claims the benefit of Chinese Patent Application No. 200620086018 entitled "Bench-Table" filed on Jun. 19, 2006, which is hereby incorporated by reference in its entirety.

BACKGROUND OF THE INVENTION

This invention relates generally to furniture pieces and, more particularly, to a collapsible furniture piece that is movable between a bench configuration having a back support and a table configuration including a table and one or more benches.

Homeowners commonly purchase patio or deck furniture to provide comfortable and relaxing sitting areas. Typically, the homeowner desires an aesthetically pleasing furniture piece to enhance the patio or deck surroundings. For example, patio or deck benches provide a comfortable and relaxing sitting area for people who wish to enjoy the weather. However, such furniture may not provide a comfortable area to enjoy a meal. As a result, many homeowners also purchase a picnic table having an eating area and benches suitable for supporting one or more people during meal times. Once the meal is finished, however, these picnic tables may not provide the comfort and relaxation provided by other patio or deck furniture. Further, because of the relatively large size of a picnic table, the picnic table may limit the available useable patio or deck space.

In view of the foregoing, several attempts have been made to provide furniture that is convertible between a bench structure and a table structure. However, such furniture does not provide a quick and easy means of converting the furniture between the different configurations. At least some conventional convertible furniture pieces require complicated mechanical components to facilitate the conversion process, which results in complex conversion steps and/or undesirably high manufacturing costs. Further, such convertible furniture is often awkward and cumbersome. Considering all these factors, conventional convertible furniture pieces require a significant amount of time and effort to configure the furniture piece in one of the different configurations. Moreover, in either configuration, such furniture pieces require a significant amount of space, which may be undesirable for homeowners having a small patio or deck area.

BRIEF DESCRIPTION OF THE INVENTION

In one aspect, a configurable furniture piece is provided. The configurable furniture piece includes a transverse member configured to at least partially support a first panel. The transverse member defines a first end portion and an opposing second end portion. A first support assembly is coupled to the first end portion of the transverse member. The first support assembly is configured to support a second panel. A second support assembly is pivotally coupled to the second end portion of the transverse member. The second support assembly is configured to support a third panel. The furniture piece is movable between a first configuration, wherein the first panel is substantially parallel to the second panel and/or the third panel, and a second configuration, wherein the first panel extends at a right angle or an oblique angle with respect to the second panel.

In another aspect, a configurable furniture piece is provided. The configurable furniture piece includes a transverse member that supports a first panel. The transverse member defines a first end portion and an opposing second end portion. A first support member is coupled to the first end portion of the transverse member. A first brace is pivotally coupled to the first support member. The first brace at least partially supports a second panel. The first support member is pivotally movable with respect to the first brace between a first configuration, wherein the first support member extends from the first brace such that the first panel is substantially parallel with the second panel, and a second configuration, wherein the first support member is substantially coplanar with the first brace such that the first panel extends at a right angle or an oblique angle with respect to the second panel.

In another aspect, a method is provided for moving a furniture piece between a first configuration and a second configuration, wherein the furniture piece includes a transverse member configured to at least partially support a first panel, a first support assembly coupled to the transverse member, the first support assembly including a first support member coupled to the transverse member and a first brace pivotally coupled to the first support member and configured to support a second panel, and a second support assembly pivotally coupled to the transverse member, the second support assembly configured to support a third panel. The method includes providing the furniture piece in a first configuration, wherein the first panel is substantially parallel to the second panel and/or the third panel. The first support member pivotally moves with respect to the first brace to move the first panel with respect to the second panel such that the first panel extends from the second panel at a right angle or an oblique angle.

In another aspect, a method is provided for collapsing a furniture piece, wherein the furniture piece includes a transverse member configured to at least partially support a first panel, a first support assembly including a first support member coupled to the transverse member, the first support assembly configured to support a second panel, and a second support assembly including a second support member pivotally coupled to the transverse member, the second support assembly configured to support a third panel. The method includes pivotally moving a first brace configured to support the second panel with respect to the first support member to move the second panel toward the first panel such that the second panel is substantially parallel to the first panel in a collapsed configuration. A support pedestal pivotally coupled to the first brace is folded toward the second panel. A third support member pivotally coupled to the second support member is folded to move the third support member to a collapsed position with respect to the second support member. The second support member is pivotally moved with respect to the transverse member to move the third panel towards the first panel such that the third panel is substantially parallel to the first panel in a collapsed configuration.

DETAILED DESCRIPTION OF THE INVENTION

The present invention provides a collapsible furniture piece that is movable between a collapsed configuration and an expanded configuration. In the expanded configuration, the furniture piece is configurable between a first configuration, wherein the furniture piece is configured as a table, such as a picnic table, having two benches each positioned with respect to an opposing longitudinal side edge of the table, and a second configuration, wherein the furniture piece is configured as a bench having a seating area and a backrest. The furniture piece is collapsible to facilitate storage and/or transport. More specifically, the furniture piece includes a frame that is movable and configurable such that the furniture piece can be configured as a table and two benches or a bench with a backrest. The frame is collapsible such that the furniture piece is configured in a compact and portable collapsed configuration suitable for storage and/or transport.

Figure 1:
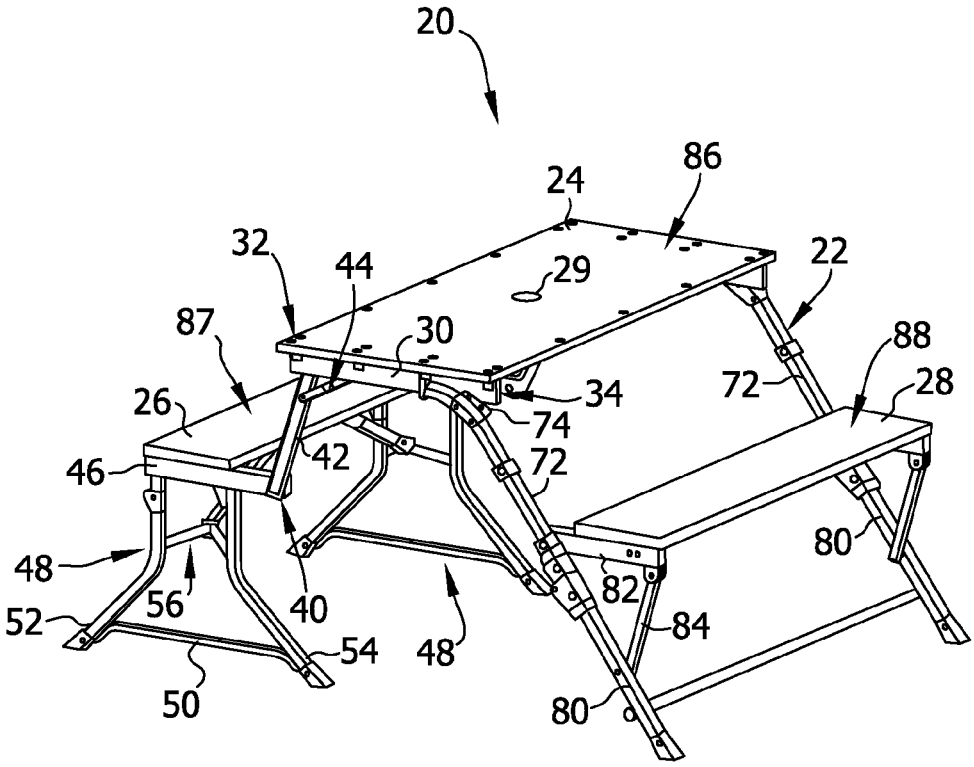
FIG. 1 is a perspective view of a furniture piece in a first or table configuration.
Figure 2:
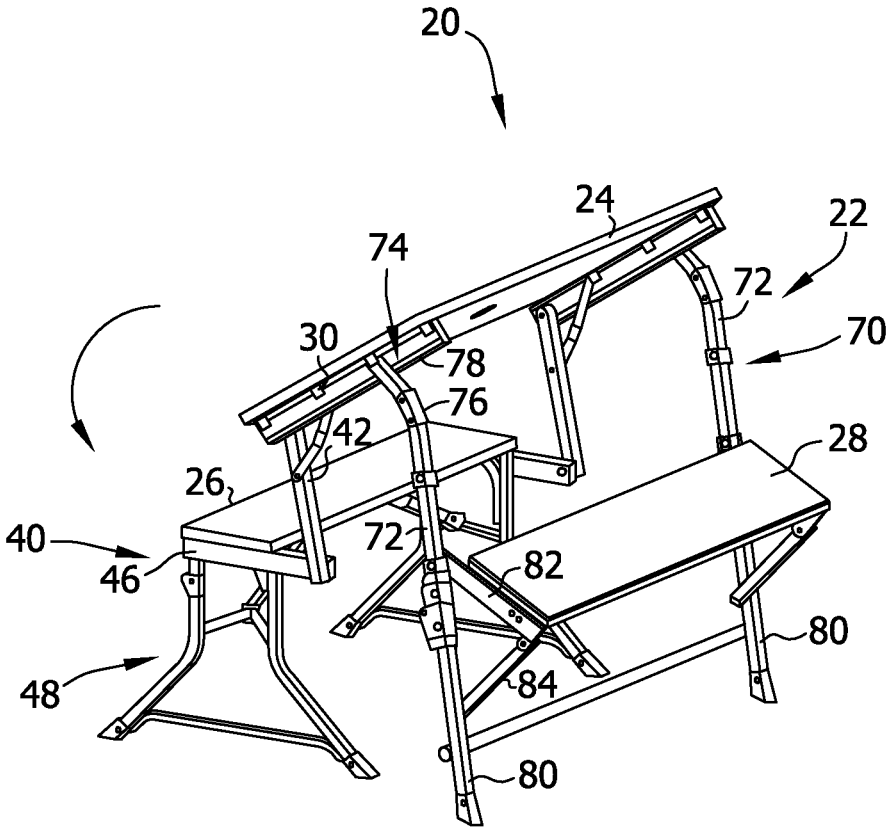
FIG. 2 is a perspective view of the furniture piece shown in FIG. 1 between the first configuration and a second or bench configuration.
Figure 3:
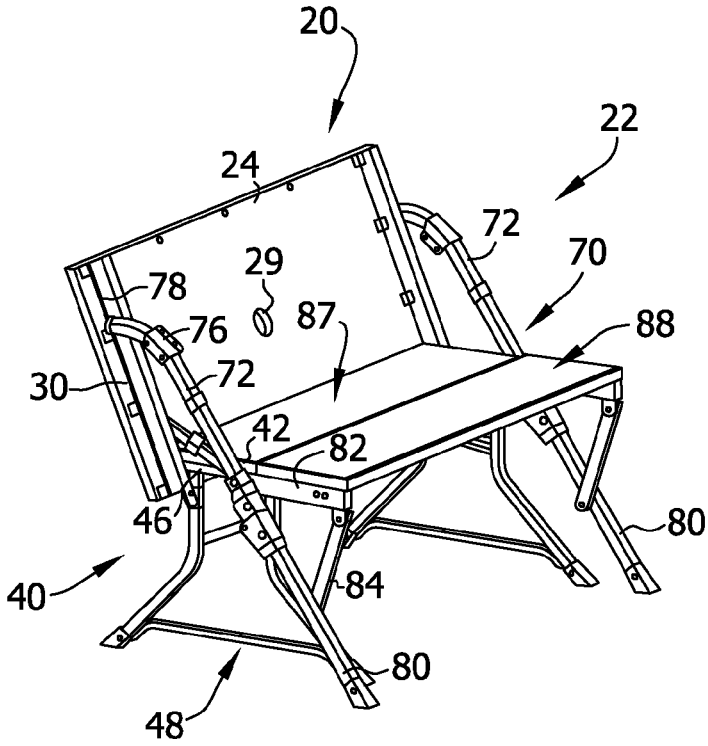
FIG. 3 is a perspective view of the furniture piece shown in FIG. 1 in the second or bench configuration.

Referring to FIGS. 1-13 and, more particularly, to FIGS. 1-3, a reconfigurable and collapsible furniture piece 20 is configurable in a first or table configuration, as shown in FIG. 1, or a second or bench configuration, as shown in FIG. 3. Furniture piece 20 is further movable to a third or collapsed configuration, as shown in FIGS. 5-13, to facilitate storing and/or transporting furniture piece 20.

Furniture piece 20 includes a frame 22 constructed to support a plurality of panels. In one embodiment, frame 22 is constructed of a lightweight material, such as an aluminum material, suitable for supporting one or more people on furniture piece 20. It should be apparent to those skilled in the art and guided by the teachings herein provided that frame 22 may be fabricated using any suitable material having sufficient strength to support one or more people and desirably lightweight to facilitate configuring and/or transporting furniture piece 20, as desired. As shown in FIG. 1, frame 22 supports a first or table/backrest panel 24, a second or seat panel 26 and a third or seat panel 28. In one embodiment, each panel 24, 26 and 28 defines a substantially planar top support surface and/or a substantially planar opposing bottom surface. In a particular embodiment, a bore 29 is defined through panel 24 such that an umbrella pole may be positioned in the bore and at least partially supported by panel 24. Panels 24, 26 and/or 28 may be fabricated using any suitable material including, without limitation, a suitable plastic, thermoplastic or thermosetting polymer, wood, metal and/or composite material. Further, each panel 24, 26 and/or 28 may include a single, unitary panel, such as shown in FIG. 1, or may include two or more boards or planks. In one embodiment, each panel 24, 26 and 28 includes a plurality of thermoplastic polymer planks, which can be shaped, molded, cast, extruded, drawn, foamed or laminated into objects, films or filaments or any suitable material using a suitable process known to those skilled in the art and guided by the teachings herein provided.

With furniture piece 20 in the first configuration, panel 24 is substantially parallel to panel 26 and/or panel 28. As shown in FIG. 1, in the first configuration, furniture piece 20 is configured as a table and two benches. With furniture piece 20 in the second configuration, panel 24 extends at a right angle or an oblique angle with respect to panel 26. Further, panel 28 is aligned adjacent to and substantially coplanar with panel 26. As shown in FIG. 3, in the second configuration, furniture piece 20 is configured as a bench with panel 26 aligned adjacent to and substantially coplanar with panel 28 and panel 24 extending from panels 26 and 28 at a right angle or an oblique angle to define a backrest or support.

Frame 22 includes at least one transverse member 30 configured to at least partially support panel 24. Transverse member 30 is coupled to panel 24 to extend substantially across a width of panel 24. Transverse member 30 defines a first end portion 32 and an opposing second end portion 34. A first support assembly 40 is coupled to first end portion 32 and is configured to support panel 26. In one embodiment, first support assembly 40 includes a first support member 42 that is pivotally coupled to transverse member 30 at first end portion 32. Support member 42 is movable between an extended position with respect to transverse member 30 such that support member 42 extends laterally outwardly and downwardly, as shown in FIG. 1, and a collapsed position with respect to transverse member 30 to facilitate moving furniture piece 20 toward the collapsed configuration. In the collapsed configuration, support member 42 is substantially coplanar with transverse member 30. In alternative embodiments, support member 42 is detachably or fixedly coupled to transverse member 30.

In a particular embodiment, a suitable locking mechanism 44 is configured to retain support member 42 in the extended position, such as shown in FIG. 1, to facilitate moving panel 24 with respect to panel 26, as described in greater detail below. In this embodiment, locking mechanism 44 includes a bracket that is pivotally movable between a locked position and an unlocked position. The bracket includes a first bracket arm that pivots with respect to transverse member 30 and a second bracket arm pivotally coupled to the first bracket arm that pivots with respect to support member 42. A projection is formed on the first bracket arm that cooperates with a recess formed on the second bracket arm such that, with support member 42 in the extended position, the projection fits into the recess to retain support member 42 in the extended position. In alternative embodiments, locking mechanism 44 may include any suitable component known to those skilled in the art and guided by the teachings herein provided.

A first brace 46 is pivotally coupled to support member 42, as shown in FIG. 1. Brace 46 is configured to at least partially support panel 26. In the embodiment shown in FIGS. 1-13, first support assembly 40 includes two support members 42 positioned at opposing longitudinal end portions of panel 24 and coupled to respective transverse member 30. Further, first support assembly 40 includes two braces 46 each pivotally coupled to respective support member 42. Brace 46 is movable between an extended position with respect to support member 42 such that panel 24 is substantially parallel with panel 26, in the first configuration as shown in FIG. 1, and a collapsed positioned with respect to support member 42 such that brace 46 is substantially coplanar with support member 42 and panel 24 extends at a right angle or an oblique angle with respect to panel 26, in the second configuration as shown in FIG. 3.

Figure 4:
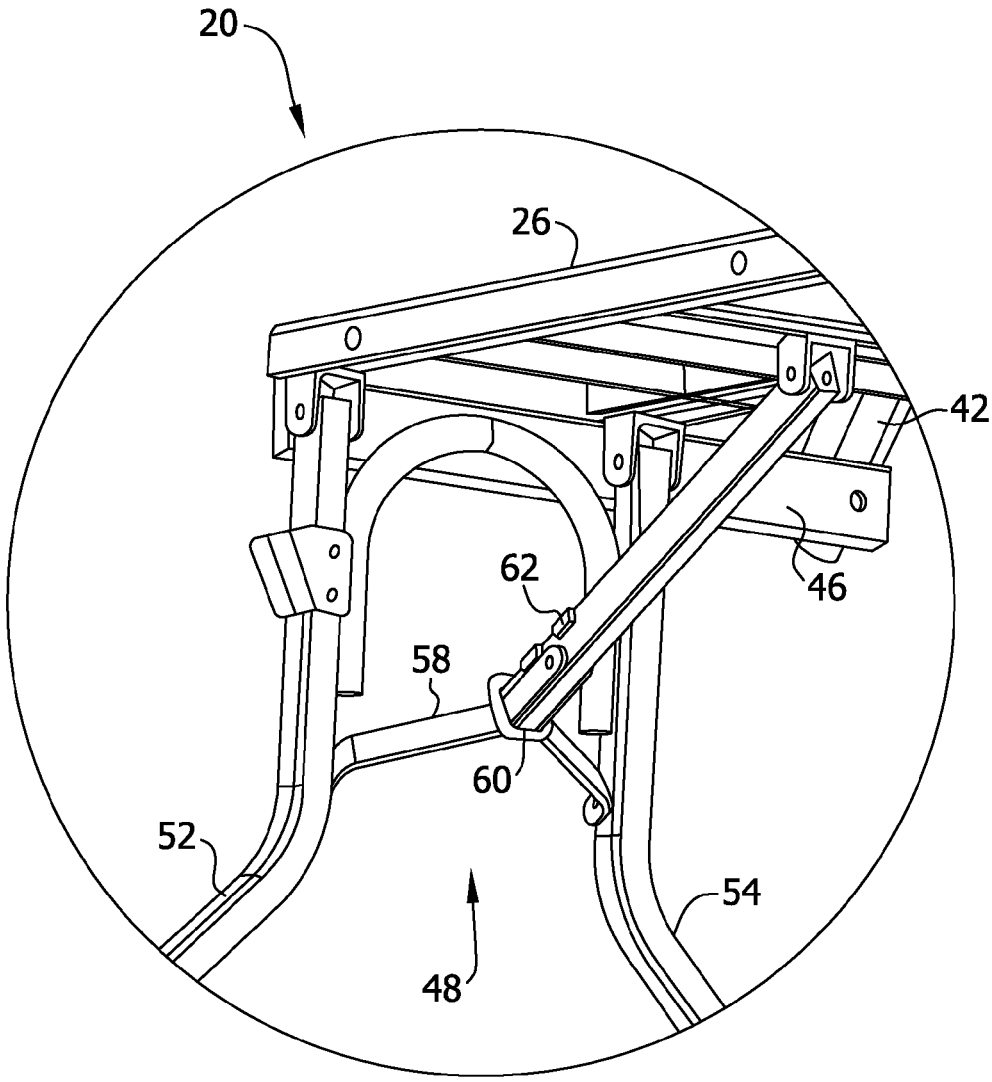
FIG. 4 is an enlarged view of a portion of the furniture piece shown in FIG. 1.
Figure 7:
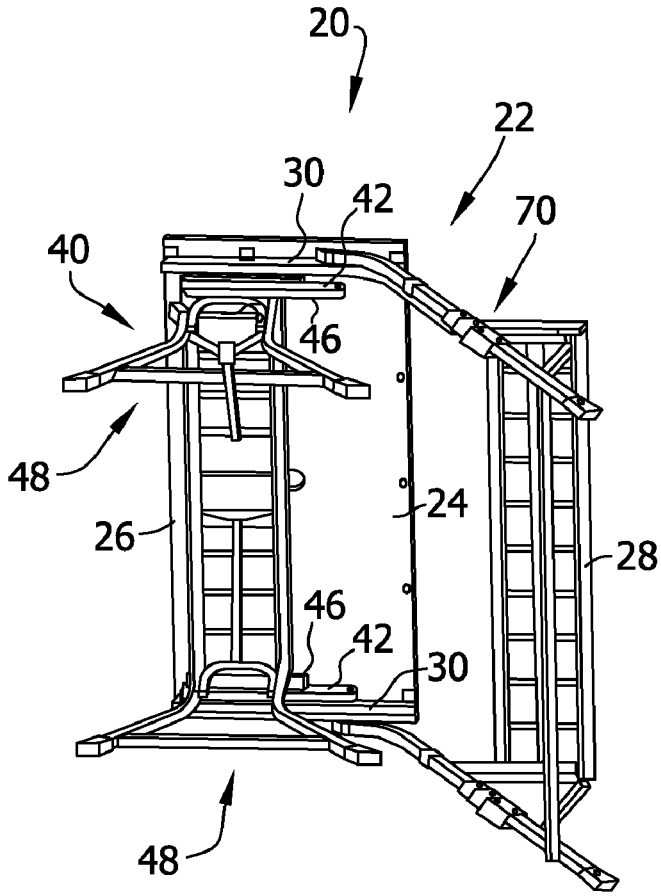
FIG. 7 is a bottom perspective view of the furniture piece shown in FIG. 1 in a partially collapsed configuration.
Figure 8:
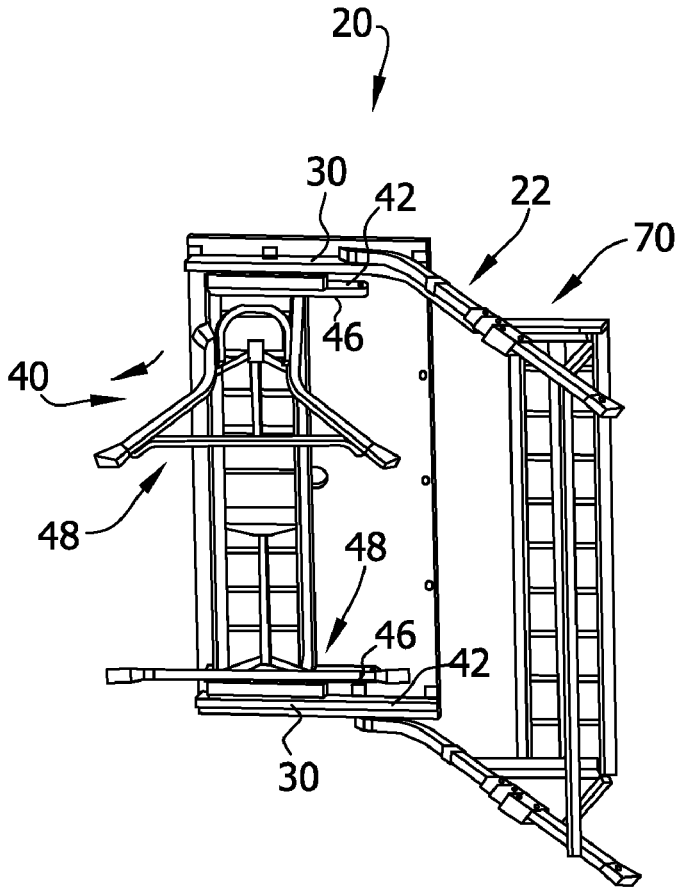
FIG. 8 is a bottom perspective view of the furniture piece shown in FIG. 1 in a partially collapsed configuration.
Figure 9:
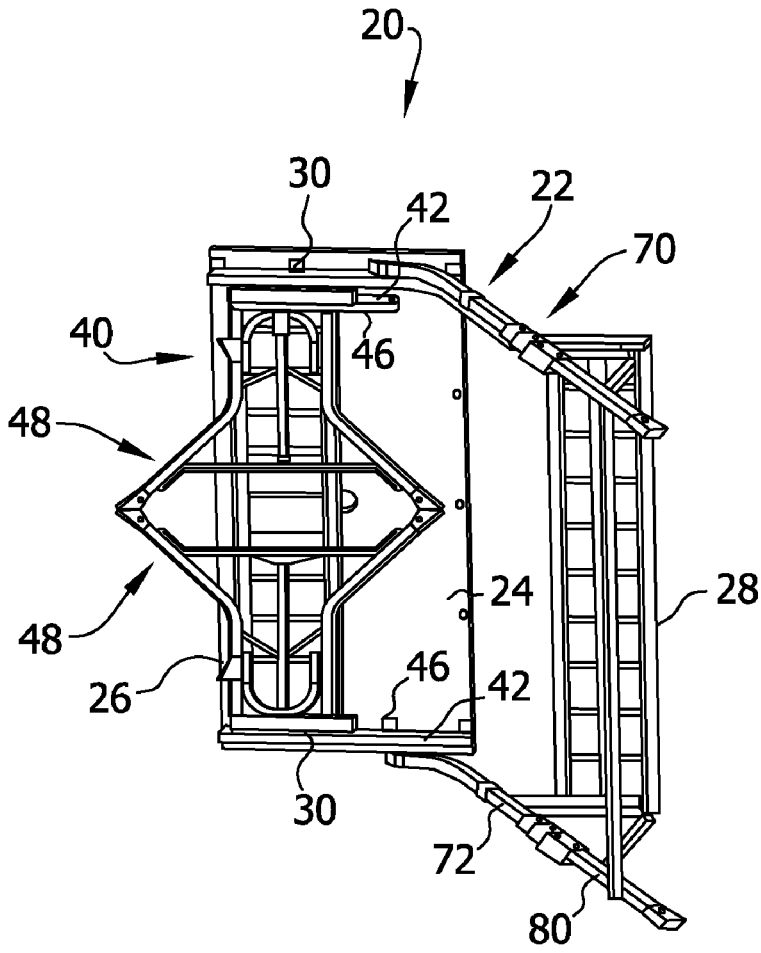
FIG. 9 is a bottom perspective view of the furniture piece shown in FIG. 1 in a partially collapsed configuration.

First support assembly 40 includes a support pedestal 48 pivotally coupled to brace 46. In a particular embodiment, support pedestal 48 includes a rail 50 that extends between opposing leg 52 and leg 54 to provide additional support to support pedestal 48. Support pedestal 48 is pivotally movable with respect to brace 46 between a collapsed position, as shown in FIG. 9, and an extended position, as shown in FIGS. 1 and 3, configured to support panel 26 with respect to a support surface, such a ground surface. A locking mechanism 56 is configured to retain support pedestal 48 in the collapsed position and/or the extended position. Referring further to FIG. 4, locking mechanism 56 includes a support brace 58 movable between a locked position and an unlocked position. In this embodiment, a ring 60 is positionable about a pivot point of support brace 58 to retain support brace 58 in the locked position. A retractable projection 62 positioned at a first end of support brace 58 is configured to fix ring 60 at the pivot point. Referring further to FIGS. 7-9, when it is desired to collapse first support assembly 40, projection 62 is moved inwardly to move ring 60 and urge support brace 58 toward the collapsed position. In alternative embodiments, locking mechanism 56 may include any suitable component known to those skilled in the art and guided by the teachings herein provided.

A second support assembly 70 is coupled to second end portion 34 of transverse member 30. Second support assembly 70 is configured to support panel 26. In one embodiment, second support assembly 70 includes a second support member 72 that is pivotally coupled to transverse member 30 at second end portion 34. Support member 72 is movable between an extended position with respect to transverse member 30 such that support member 72 extends laterally outwardly and downwardly, as shown in FIG. 1, and a collapsed position with respect to transverse member 30 to facilitate moving furniture piece 20 toward the second configuration or the collapsed configuration. With furniture piece 20 in the collapsed configuration, support member 72 is substantially coplanar with transverse member 30. In alternative embodiments, second support assembly 70 is detachably or fixedly coupled to transverse member 30.

In a particular embodiment, as shown in FIG. 2, a suitable locking mechanism 74 is configured to engage transverse member 30 to facilitate coupling support assembly 70 to transverse member 30. In this embodiment, locking mechanism 74 includes a clamp or collar 76 positioned about at least a portion of an outer surface of support member 72. Collar 76 is positionable within a cooperating slot 78 or other suitable retainer formed in or coupled to transverse member 30 such that support member 72 is frictionally fitted to transverse member 30 to retain support member 72 in an extended position with respect to transverse member 30. In alternative embodiments, locking mechanism 74 may include any suitable component known to those skilled in the art and guided by the teachings herein provided.

Figure 11:
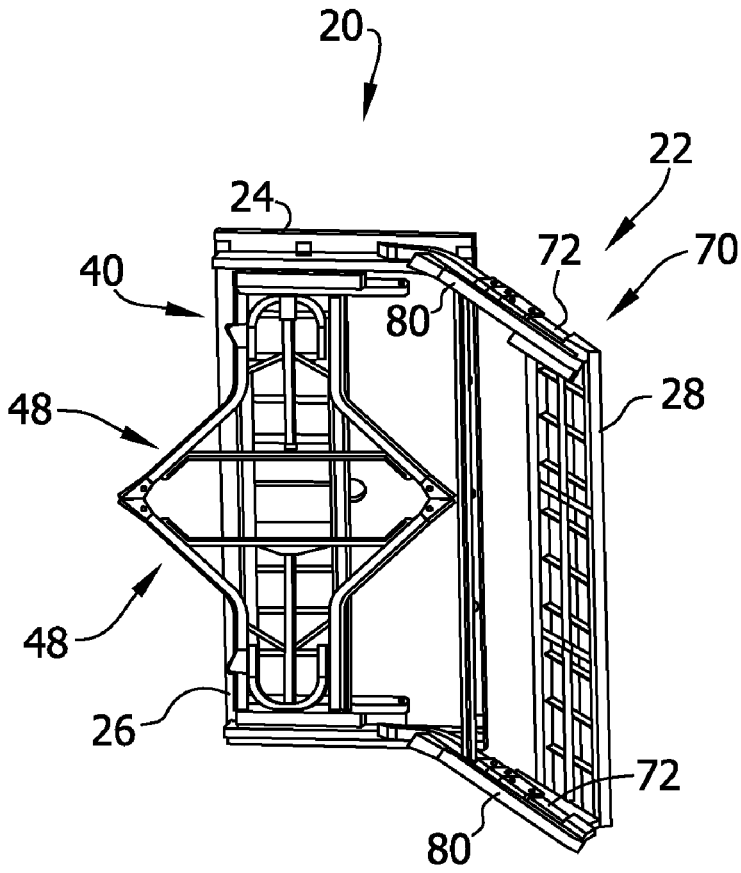
FIG. 11 is a bottom perspective view of the furniture piece shown in FIG. 1 in a partially collapsed configuration.
Figure 12:
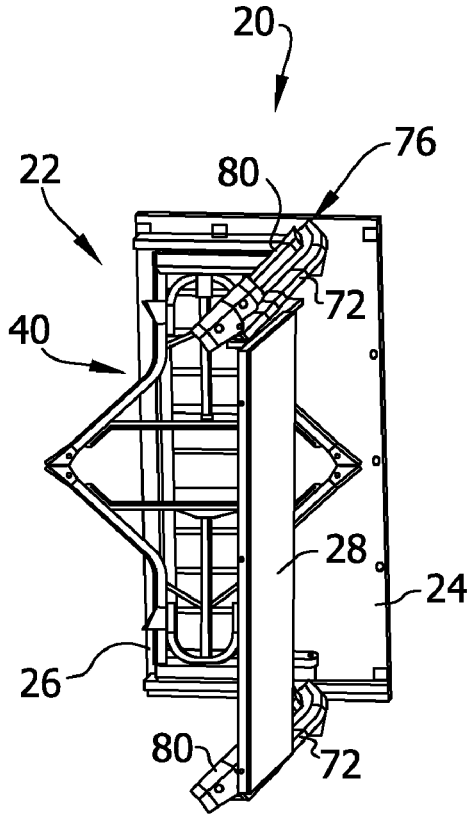
FIG. 12 is a bottom perspective view of the furniture piece shown in FIG. 1 in a partially collapsed configuration.
Figure 13:
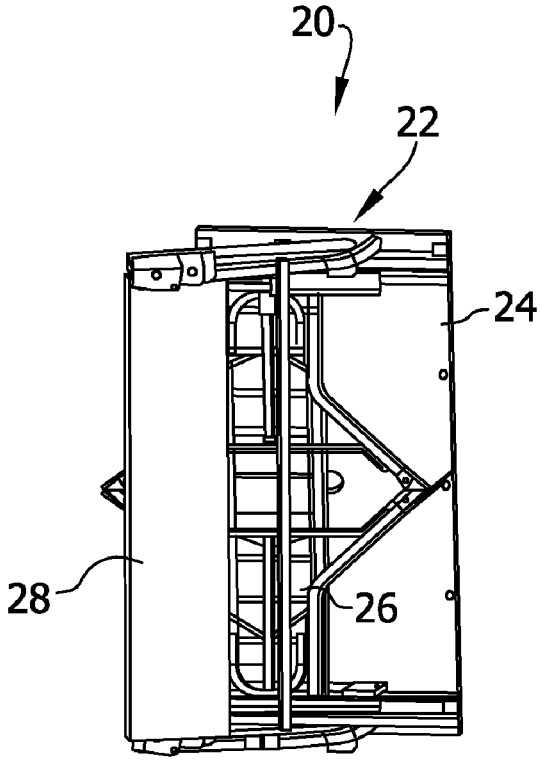
FIG. 13 is a bottom perspective view of the furniture piece shown in FIG. 1 in a fully collapsed configuration.

A third support member 80 is pivotally coupled to support member 72 and is movable between a collapsed position, such as shown in FIGS. 11-13, and an extended position, such as shown in FIGS. 1 and 3, with respect to support member 72. In the extended position, support member 80 is configured to facilitate supporting panel 28 with respect to a support surface, such the ground surface. In one embodiment, support member 80 is pivotally coupled to a lower end of support member 72 at a pivoting point and a projection is coupled to support member 72 or support member 80 at or near the pivoting point to prevent or limit the extension of support member 80 with respect to support member 72, such as to a maximum extension angle of about 180°.

A second brace 82 is pivotally coupled to support member 72 and/or support member 80 and configured to at least partially support panel 28. In one embodiment, brace 82 is pivotally coupled to support member 72. In a particular embodiment, a third brace 84 is coupled between brace 82 and support member 80 to facilitate supporting panel 28 with brace 82 in an extended position with respect to support member 72. In the embodiment shown in FIGS. 1-13, second support assembly 70 includes two support members 72 positioned at opposing longitudinal end portions of panel 24 and coupled to a respective transverse member 30. Further, second support assembly 70 includes two braces 82 each pivotally coupled to respective support member 72.

With furniture piece 20 in the first configuration as shown in FIG. 1, brace 82 is positioned in an extended position with respect to support member 72 and panel 24 is substantially parallel with panel 28. With furniture piece 20 in the second configuration as shown in FIG. 3, brace 82 is positioned in the extended position with respect to support member 72 and panel 24 extends at a right angle or an oblique angle with respect to panels 26 and 28 with panel 26 aligned adjacent to and substantially coplanar with panel 28.

Referring to FIGS. 1-3, configurable furniture piece 20 is movable between the first configuration, as shown in FIG. 1, and the second configuration, as shown in FIG. 3. FIG. 1 illustrates furniture piece 20 in the first or table configuration with panel 24 substantially parallel to panel 26 and/or panel 28. In this configuration, panel 24 is configured as a table top defining a support surface 86, and panel 26 defines a seating area 87 and panel 28 defines a seating area 88 each configured to support one or more people with respect to support surface 86. As shown in FIG. 2, support member 42 is pivotally moved with respect to brace 46 to move panel 24 with respect to panel 26 such that panel 24 extends from panel 26 at a right angle or an oblique angle, as shown in FIG. 3. In a particular embodiment, locking mechanism 44 retains support member 42 locked in the extended position with respect to transverse member 30 to facilitate pivotally moving support member 42 with respect to brace 46. As support member 42 pivotally moves toward brace 46, support member 72 pivotally moves from a locked position with respect to transverse member 30 to move panel 28 toward panel 26. In the second configuration as shown in FIG. 3, panel 28 is aligned adjacent to and substantially coplanar with panel 26 to form a seating area 90 including seating area 87 and seating area 88 configured to support one or more people. Further, panel 24 is positioned at a right angle or an oblique angle with respect to panels 26 and 28 to form a suitable backrest configured to facilitate supporting the one or more people sitting on panels 26 and 28.

Figure 5:
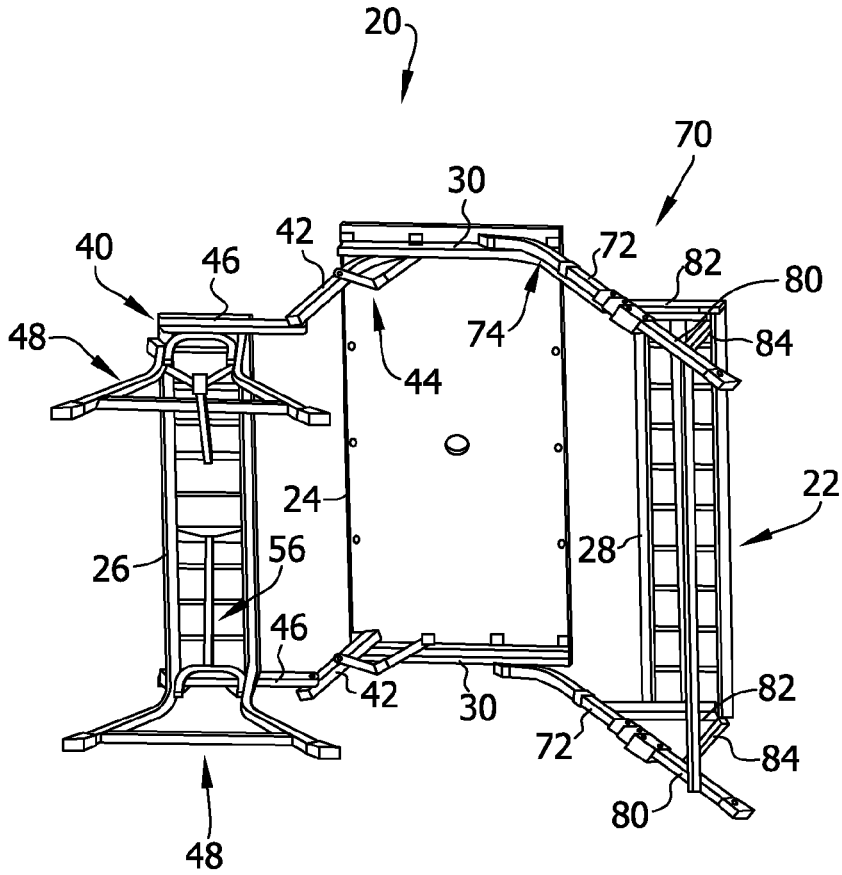
FIG. 5 is a bottom perspective view of the furniture piece shown in FIG. 1.
Figure 6:
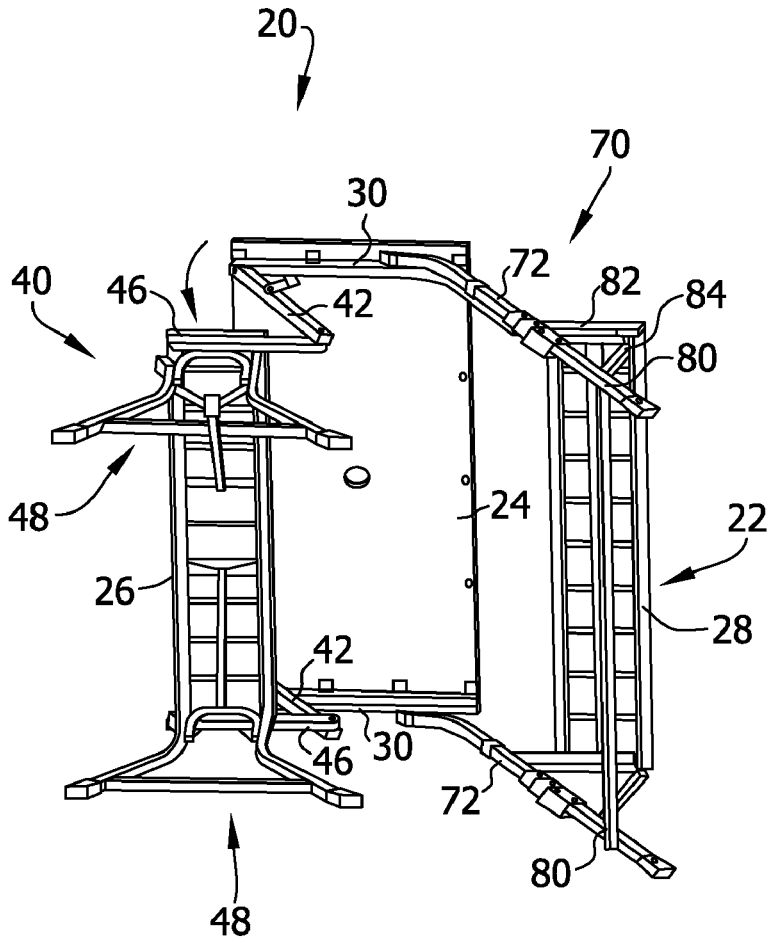
FIG. 6 is a bottom perspective view of the furniture piece shown in FIG. 1 in a partially collapsed configuration.

Referring now to FIGS. 5-13, configurable furniture piece 20 is collapsible to a compact, collapsed configuration, such as shown in FIG. 13, to facilitate storing and/or transporting furniture piece 20. To collapse furniture piece 20 from the first configuration as shown in FIG. 5, brace 46 is pivotally moved with respect to support member 42 to move panel 26 toward panel 24 such that panel 26 is substantially parallel to panel 24 in a collapsed position adjacent panel 24, as shown in FIGS. 6 and 7. More specifically, panel 26 is moved toward panel 24 such that the surface of seating area 87 approaches a bottom surface of panel 24. With panel 26 in the collapsed position, support pedestal 48 is folded toward panel 26 by pivotally moving support pedestal 48 with respect to brace 46, as shown in FIGS. 8 and 9.

Figure 10:
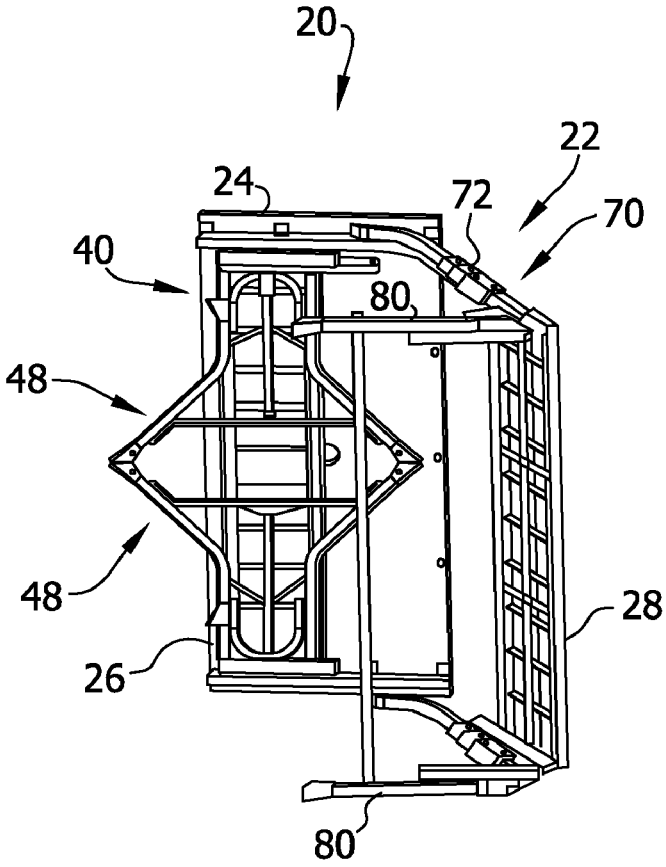
FIG. 10 is a bottom perspective view of the furniture piece shown in FIG. 1 in a partially collapsed configuration.

Brace 82 is folded toward support member 72 to pivotally move panel 28 toward support member 72. Referring to FIGS. 10 and 11, support member 80 is then folded with respect to support member 72 such that support member 80 is pivotally moved toward support member 72 to a collapsed position with respect to support member 72. In the collapsed position, support member 80 rests adjacent to support member 72. Support member 72 is then pivotally moved with respect to transverse member 30 to move panel 28 toward panel 24 such that panel 28 is substantially parallel to panel 24 in a collapsed configuration. More specifically, panel 28 is moved toward panel 24 such that the surface of seating area 88 approaches the bottom surface of panel 24. Support assembly 70 is then pivotally moved with respect to transverse member 30 to move support assembly 70 toward panel 24 to collapse furniture piece 20, as shown in FIGS. 12 and 13.

The above-described furniture piece is configurable as a table having two benches or a bench having a backrest. Further, the furniture piece is collapsible to facilitate storage and/or transport. More specifically, the furniture piece frame is movable and configurable such that the furniture piece can be configured as a table and two associated benches or a bench with a backrest. The frame is collapsible such that the furniture piece is configured in a compact and portable collapsed configuration suitable for storage and/or transport.

Exemplary embodiments of a configurable and collapsible furniture piece and a method of configuring or collapsing the furniture piece are described above in detail. The methods and apparatus are not limited to the specific embodiments described herein, but rather, steps of the methods and/or components of the apparatus may be utilized independently and separately from other steps and/or components described herein. Further, the described method steps and/or apparatus components can also be defined in, or used in combination with, other methods and/or apparatus, and are not limited to practice with only the methods and apparatus as described herein.

While the invention has been described in terms of various specific embodiments, those skilled in the art will recognize that the invention can be practiced with modification within the spirit and scope of the claims.

What is claimed is:

1. A configurable furniture piece comprising:

a frame movable between a collapsed configuration and an expanded configuration, said frame comprising:

a transverse member configured to at least partially support a first panel, said transverse member defining a first end portion and an opposing second end portion;

a first support assembly coupled to said first end portion of said transverse member, said first support assembly configured to support a second panel; and a second support assembly pivotally coupled to said second end portion of said transverse member, said second support assembly configured to support a third panel, with said frame in the expanded configuration, said furniture piece movable between a first configuration, wherein said first panel is substantially parallel to at least one of said second panel and said third panel, and a second configuration, wherein said first panel extends at one of a right angle and an oblique angle with respect to said second panel.

2. A configurable furniture piece in accordance with claim 1 wherein said first support assembly further comprises a first support member pivotally coupled to said transverse member.

3. A configurable furniture piece in accordance with claim 2 further comprising a locking mechanism configured to retain said first support member in the extended position to facilitate moving said first panel with respect to said second panel.

4. A configurable furniture piece in accordance with claim 2 wherein said first support assembly further comprises a brace pivotally coupled to said first support member, said brace configured to support said second panel.

5. A configurable furniture piece in accordance with claim 4 wherein said first support assembly further comprises a support pedestal pivotally coupled to said brace, said support pedestal movable with respect to said brace between a collapsed position and an extended position.

6. A configurable furniture piece in accordance with claim 5 further comprising a locking mechanism configured to lock said support pedestal in at least one of the collapsed position and the extended position.

7. A configurable furniture piece in accordance with claim 2 wherein said second support assembly further comprises:

a second support member pivotally coupled to said transverse member; and a third support member pivotally coupled to said second support member, said third support member movable between a collapsed position and an extended position with respect to said second support member.

8. A configurable furniture piece in accordance with claim 7 wherein said second support assembly further comprises a first brace pivotally coupled to at least one of said second support member and said third support member, said first brace configured to support said third panel.

9. A configurable furniture piece in accordance with claim 8 further comprising a second brace coupled between said first brace and said third support member to facilitate supporting said third panel with said first brace in an extended position with respect to said second support member.

10. A configurable furniture piece in accordance with claim 1 wherein said second support assembly further comprises a clamp mounted to said second support assembly and configured to engage said transverse member to facilitate coupling said second support assembly to said transverse member.

11. A configurable furniture piece in accordance with claim 1 wherein, in the first configuration, said configurable furniture piece is configured as a table and two benches.

12. A configurable furniture piece in accordance with claim 1 wherein, in the second configuration, said configurable furniture piece is configured as a bench, said second panel aligned adjacent to and substantially coplanar with said third panel.

13. A configurable furniture piece in accordance with claim 1 wherein at least one of said first panel, said second panel and said third panel further comprises a plurality of planks.

14. A configurable furniture piece in accordance with claim 1 wherein said furniture piece is configurable in a collapsed configuration.

15. A configurable furniture piece comprising:

a frame movable between a collapsed configuration and an expanded configuration, said frame comprising:

a transverse member supporting a first panel, said transverse member defining a first end portion and an opposing second end portion;

a first support member coupled to said first end portion of said transverse member; and a first brace pivotally coupled to said first support member, said first brace at least partially supporting a second panel, with said frame in the expanded configuration, said first support member pivotally movable with respect to said first brace between a first configuration, wherein said first support member extends from said first brace such that said first panel is substantially parallel with said second panel, and a second configuration, wherein said first support member is substantially coplanar with said first brace such that said first panel extends at one of a right angle and an oblique angle with respect to said second panel.

16. A configurable furniture piece in accordance with claim 15 further comprising:

a second support member pivotally coupled to said second end portion of said transverse member;

a third support member pivotally coupled to said second support member, said third support member movable between a collapsed position and an extended position with respect to said second support member; and a second brace pivotally coupled to said second support member, said second brace supporting a third panel, in the first configuration, said first panel substantially parallel to said third panel and in the second configuration said third panel aligned adjacent said second panel.

17. A configurable furniture piece in accordance with claim 16 wherein, in the first configuration, said configurable furniture piece is configured as a table and two benches.

18. A configurable furniture piece in accordance with claim 16 wherein, in the second configuration, said configurable furniture piece is configured as a bench having a backrest.

19. A configurable furniture piece in accordance with claim 15 further comprising a support pedestal pivotally coupled to said first brace, said support pedestal movable between a collapsed position and an extended position with respect to said first brace.

20. A method for moving a furniture piece between a first configuration and a second configuration, the furniture piece comprising a frame movable between a collapsed configuration and an expanded configuration, the frame comprising a transverse member configured to at least partially support a first panel, a first support assembly coupled to the transverse member, the first support assembly comprising a first support member coupled to the transverse member and a first brace pivotally coupled to the first support member and configured to support a second panel, and a second support assembly pivotally coupled to the transverse member, the second support assembly configured to support a third panel, said method comprising:

with the frame in the expanded configuration, providing the furniture piece in a first configuration, wherein the first panel is substantially parallel to at least one of the second panel and the third panel; and pivotally moving the first support member with respect to the first brace to move the first panel with respect to the second panel such that the first panel extends from the second panel at one of a right angle and an oblique angle.

21. A method in accordance with claim 20 further comprising locking the first support member with respect to the transverse member in an extended position to facilitate pivotally moving the first support member with respect to the first brace.

22. A method in accordance with claim 20 further comprising pivotally moving the second support assembly with respect to the transverse member to move the third panel towards the second panel.

23. A method for collapsing a furniture piece, the furniture piece comprising a frame movable between a collapsed configuration and an expanded configuration, the frame comprising a transverse member configured to at least partially support a first panel, a first support assembly comprising a first support member coupled to the transverse member, the first support assembly configured to support a second panel, and a second support assembly comprising a second support member pivotally coupled to the transverse member, the second support assembly configured to support a third panel, said method comprising:

with the frame in the expanded configuration, pivotally moving a first brace configured to support the second panel with respect to the first support member to move the second panel toward the first panel such that the second panel is substantially parallel to the first panel in a collapsed configuration;

folding a support pedestal pivotally coupled to the first brace toward the second panel;

folding a third support member pivotally coupled to the second support member to move the third support member to a collapsed position with respect to the second support member; and pivotally moving the second support member with respect to the transverse member to move the third panel towards the first panel such that the third panel is substantially parallel to the first panel in a collapsed configuration.

24. A method in accordance with claim 23 further comprising folding a second brace configured to support the third panel toward the second support member to move the third panel toward the second support member.

25. A configurable furniture piece comprising:

a transverse member configured to support a first panel, said transverse member defining a first end portion and an opposing second end portion;

a first support assembly coupled to said first end portion of said transverse member, said first support assembly configured to support a second panel;

a second support assembly pivotally coupled to said second end portion of said transverse member, said second support assembly configured to support a third panel; and a clamp mounted to said second support assembly and configured to engage said transverse member to facilitate coupling said second support assembly to said transverse member, said furniture piece movable between a first configuration, wherein said first panel is substantially parallel to at least one of said second panel and said third panel, and a second configuration, wherein said first panel extends at one of a right angle and an oblique angle with respect to said second panel.

* * * * *